United States Patent [19]

Wiking et al.

[11] 4,209,060

[45] Jun. 24, 1980

[54] PACK, COMPRISING A STACK OF ABUTTING RECTANGULAR PLATES, INTENDED FOR A REGENERATIVE HEAT EXCHANGER, AND A METHOD OF MANUFACTURING SUCH A PACK

[75] Inventors: Hakan Wiking; Bo Johnsson, both of Göthenburg, Sweden

[73] Assignee: Lars Wiking, Göthenburg, Sweden

[21] Appl. No.: 940,235

[22] Filed: Sep. 7, 1978

[30] Foreign Application Priority Data

Sep. 16, 1977 [SE] Sweden ..... 7710409

[51] Int. Cl.[2] ..... F28D 19/04

[52] U.S. Cl. ..... 165/8; 165/10

[58] Field of Search ..... 165/8, 9, 10

[56] References Cited

U.S. PATENT DOCUMENTS

| | | | |
|---|---|---|---|
| 2,549,583 | 4/1951 | Eckersley | 165/5 |
| 3,605,874 | 9/1971 | Brunell | 165/9 |
| 3,874,442 | 4/1975 | Johnsson | 165/10 |
| 3,996,997 | 12/1976 | Regan et al. | 165/8 |

FOREIGN PATENT DOCUMENTS

| | | | |
|---|---|---|---|
| 1285255 | 1/1962 | France | 165/10 |

*Primary Examiner*—Albert W. Davis

*Attorney, Agent, or Firm*—Sughrue, Rothwell, Mion, Zinn and Macpeak

[57] ABSTRACT

In a pack of rectangular plates to be used in a regenerative heat exchanger the plates are kept in position by a plurality of mutually parallel tension rods passing through registering openings in the plates. Each tension rod has at its ends securing means co-operating with the outer plates of the stack for holding the plates pressed against each other. At least one of the tension rods is provided with a lifting eye device which can be moved into the pack and out of the pack, respectively.

8 Claims, 5 Drawing Figures

Figure 1:
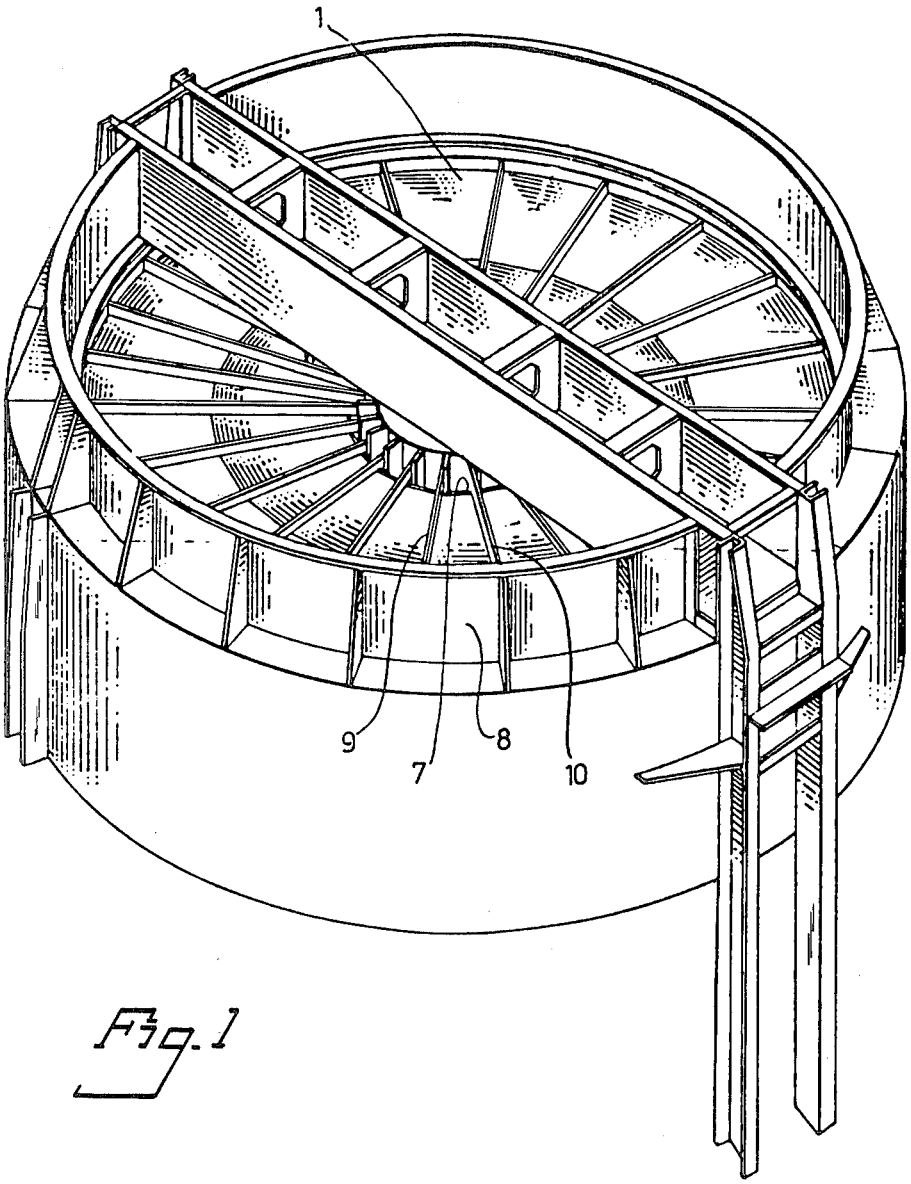

PACK, COMPRISING A STACK OF ABUTTING RECTANGULAR PLATES, INTENDED FOR A REGENERATIVE HEAT EXCHANGER, AND A METHOD OF MANUFACTURING SUCH A PACK

The invention relates to a pack containing a stack of abutting rectangular plates, intended for placing in a compartment defined by radial and tangential walls in a regenerative heat exchanger of the rotary type, said plates being profiled such that they form passages for a heat exchanging medium between two parallel end surfaces of the pack, these being means for keeping the plates together in the pack.

The number of heat-exchanging plates in the rotary and substantially cylindrical regenerator part of an air preheater can attain as many as 100,000. It is therefore not possible to place each separate plate by hand, for practical and economical reasons. The plates are therefore arranged in packs of a suitable shape, and the plates are usually stacked in conjunction with stamping, the plates being placed in basket-like containers, which are lowered into compartments in the regenerator part according to a definite pattern. Such baskets with plates are described in the British Pat. Nos. 1,103,207 and 1,174,513, for example.

Packs of this type are expensive to manufacture and give rise to the very great disadvantage that air spaces are formed between each pack and the walls of the associated compartment. Such gaps form leakage paths for the heat exchanging medium and losses will be large.

It has been found that an air gap in the order of magnitude of 6 mm between the pack and surrounding radial and tangential walls causes an increase in the temperature of the outgoing medium in the order of magnitude of 6°–7° C., giving a loss of 750–900 tonnes of fuel oil per year in a 100 MW power station. It has been sought to avoid this leakage by applying seals between the basket and the compartment walls, but this only results in a pressure drop in the flow direction, and efficiency does not increase. There is no possibility of reducing the gap to below 6 mm when baskets are used to keep the stacks of plates together.

Attempts have also been made to provide plate packs without baskets, to reduce the clearance between packs and walls to about 3 mm. Such a clearance is namely quite acceptable, since practical attempts have shown that heat transfer is not made worse. A known pack without a basket is described in the British Pat. No. 1,401,622, and consists of heat exchanging plates stacked one on top of the other, and kept together by a bottom frame, against which one end of the pack is in contact, steel strapping being drawn round frame and stack to keep the plates pressed against each other during transport. The frame is provided with a vertical lifting bar, projecting up through the top surface. When the pack has been placed in its compartment, the strapping is cut and removed, whereon the stack of plates expands radially the tangential walls. In order to keep the plates located to each other during packaging, radially directed, loose guide rods thrust into holes in plate stack are used, these rods also having the object of preventing the plates gliding laterally relative to each other in the compartment when the strapping is removed. Even if some improvement with regard to gas leakage can be obtained by the stack expanding towards the tangential walls, such a pack construction has several drawbacks. The necessary bottom frame for carrying the whole weight of the pack, e.g. 200–400 kg, during lifting is expensive and reduces the utilizable space in the heat exchanger rotor, and the tightly tensioned strapping causes deformation of the edge portions of the outer plates, which increases the pressure drop. The strapping is also difficult to remove after the pack has been lowered into the compartment. The radial expansion of the plate stack after the strapping has been cut often causes plates in the stack to lie at some distance from each other, and thereby the channel formation between adjacent plates, provided by profiling the plates, is neutralized, resulting in lowering of the efficiency.

It is therefore a main object of the invention to provide a pack of the type described in the introduction, which can be easily manufactured with such tolerances that the leakage between the pack and the surrounding walls is reduced to negligible values, and which even after fitting in the rotor retains its shape and does not need any carrying bottom frame.

This object is essentially attained by the plate stack being penetrated by a plurality of tension rods, the end points of which have stop means coacting with the outside of the outermost plates in the stack.

The tension rods, preferably with a rectangular cross section and the narrow edge surfaces facing towards the flow direction of the medium, keep the plates pressed against each other in the intended position. At one end, each rod preferably has a fixed washer-like head engaging against the outer plate on one side surface of the pack and at its other end a similar head, which has been welded on the end after the rod has been thrust through associated, mutually aligned holes in the plates.

After the tension rods have been fitted and the loose washer welded onto the free end of the respective rod, a rigid dimensionally stable pack is obtained, the tolerance of which can be kept within very tight limits and adapted to the space in a compartment in the rotor of the regenerative heat exchanger. The leakage between the walls of the compartment and the pack can thus be kept to a minimum and the efficiency of the heat exchanger to a maximum. A pack according to the invention will furthermore be easier and simpler to manufacture than conventional packs.

The invention further relates to a method of manufacturing a pack according to the above, said method being essentially characterized in that in each plate intended for a pack there are punched a plurality of holes in predetermined positions of a size and shape corresponding to the cross-sectional area of an associated tension rod, that the plates are stacked one on top of the other so that the holes for each rod are aligned that through each set of holes aligned with each other there is inserted a tension rod with a first stop means at one end, that to said end on each tension rod there is applied a compressive force, that a second stop means with an aperture for accomodating the face end of the respective rod forms a rigid abutment, and that after the free end of the respective tension rod has been moved into said aperture under the action of the compressive force and thereby achieved a definite compression of the plates in the pack, said second stop means is fixed to the free end of the respective rod and in engagement with the pack.

The stop means, expediently consisting of steel washers with substantially greater contact surfaces to the outer plates that the cross-sectional area of the associated tension rod are suitably united thereto by welding. The fixed stop means or head can however be pressed from bar material.

Other characterizing features essential to the invention are apparent from the following description and from the patent claims.

Figure 2:
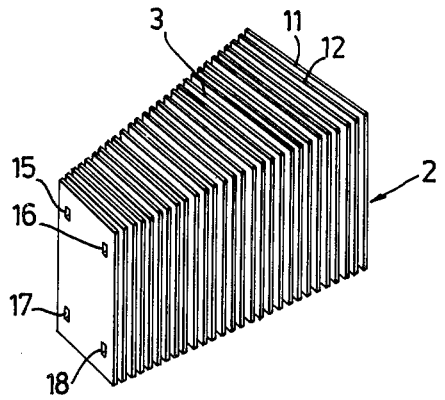
Figure 3:
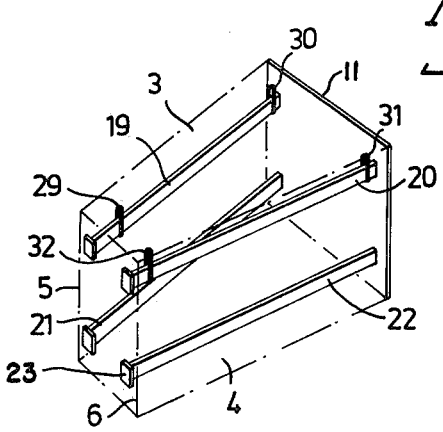
Figure 4:
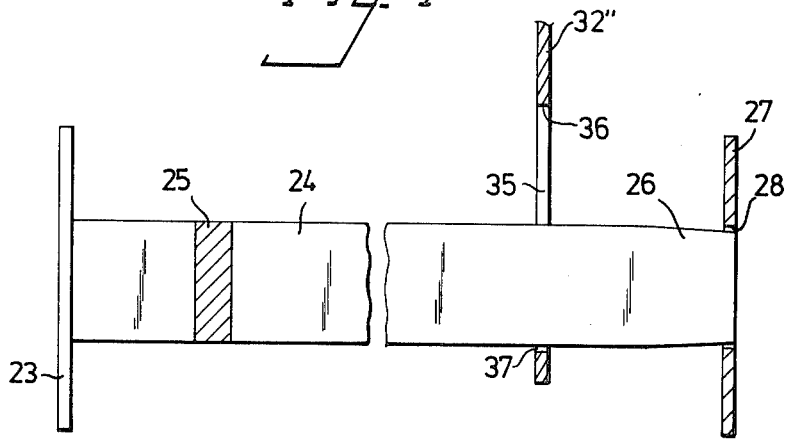
Figure 5:
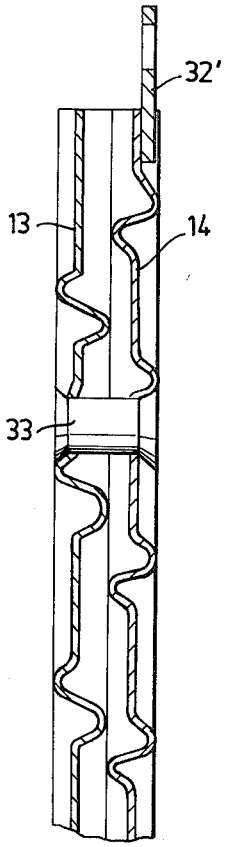

The invention will now be described below in conjunction with the appended drawings, on which FIG. 1 shows a perspective view of a regenerative air preheater of rotary type with packs according to the invention accommodated in compartments, FIG. 2 shows a simplified perspective view of a stack of plates, FIG. 3 shows schematically a pack with four tension rods and lifting means in the form of wire rope loops, FIG. 4 shows a tension rod with a loose, sectioned stopwasher and FIG. 5 shows a section through two heat exchanger plates, united with each other, and a lifting eye united with one of the plates.

In the drawing figures, the numeral 1 generally denoted a plate pack with a stack 2 of plate elements which, although this is not clearly apparent from FIGS. 1–3, are profiled in a way well-known per se, so that channels are formed between two plates abutting each other for the heat-exchanging medium, e.g. gas or air. The through-flow channels or passages are best apparent from FIG. 5, which shows portions of two plates seen in the direction of flow. All the plates in a pack have the same height, but successively changing width, so that the pack will be given trapezoidal shape. The top 3 and bottom 4 end surfaces of the stack are parallel to each other and both side surfaces 5, 6 converge towards an inward tangential wall 7 in a compartment in the rotor of the preheater. Such a compartmend is defined by the tangential walls 7, 8 and two radial walls 9, 10. Each plate, e.g. plates 11, 12 in FIG. 2, is manufactured with very close tolerances, and when the plates are stacked the edges will completely coincide with the plane of the side surfaces 5 and 6, which is of the greatest importance for the air gaps to the respective radial wall 9, 10 being kept to a definite minimum—equal to or less than 3 mm.

To provide a pack according to the invention, a plurality of holes in definite positions have been punched out of the plates, e.g. holes 15,16,17 and 18 in FIG. 2. The holes 15 in each plate will be aligned with each other when the stack is made up, and will form passages going through all the plates for receiving the tension rods 19,20,21,22.

As is best apparent from FIG. 4, a tension rod according to FIG. 3 has a head, conceived here as rectangular, but which can have any suitable shape at all. This head 23 is rigidly attached to a flat bar 24 of rectangular cross section 25. After fitting the finished pack in a compartment in the horizontal rotor shown in FIG. 1, the head 23 will be facing towards a tangential wall, e.g. the wall 7 in FIG. 1, and must have as little thickness as possible, preferably not exceeding 3 mm, so that the greatest possible efficiency of the preheater will be obtained. The flat bar can have a height of 44 mm and a width of 5 mm, for example. The width of the bar should be as small as possible to give the least possible resistance to the air or gas flow through the pack. Tension rods 19–22 fit in the associated holes 15–18. The bars can be ground somewhat tapered along their whole length or within the end portion 26. The holes 15–18 have the same cross-sectional shape as the tension rods, and an area only insignificantly exceeding that of the bars, so that the plates will be kept in fixed locations on the rods.

After a stack of plates has been made up, the tension rods 19–22 are inserted in the passages formed by the holes in registry with each other in the plates and the plate stack is compressed by a compressing means acting on the heads of the rods, e.g. head 23. A washer 27, with an aperture 28 corresponding to the cross section of the bar, coacts with the free end portion, e.g. end portion 26 or the respective rod, the washer being kept stationary. After the plate stack has been pressed together a definite amount and the free end portion 26 pressed into the aperture 28 of the washer 27, the end portion 26 and the washer 27 are welded together, and since the washer 27 is pressed against an outer plate, like the head 23, the plates will be retained in fixed positions relative to each other. It is possible to use other cross-sectional shapes for the tension rods, e.g. circular, but the rectangular one with small width in relation to height is preferred, since small flow resistance is obtained, and sufficient stiffness for lifting the entire pack while utilizing one or more tension rod. In FIG. 3, both the upper rods 19, 20 are shown provided with lifting eyes 29, 30, 31, 32. These eyes consist of wire rope loops placed around the respective rod and between two plates, and projecting up beyond the top end surface of the pack. When several packs are to be stacked on top of each other, these loops can easily be pushed down between the plates. It is also possible to apply other types of lifting means, e.g. lifting eyes made from flat bar, which are welded to one or more plates in the pack. Such a lifting eye 32' is shown welded to the plate 14 in FIG. 5.

The tension rods, the number of which can be varied, but are for example four, as shown in FIG. 3, are preferably in planes parallel to the end surfaces 3,4, which are mutually parallel, but do not need to lie in those planes. In FIG. 3 the rods 19,20 and 21,22, respectively, are shown diverging from each other from left to right. It is, however, also possible to allow the rods to go parallel to each other, whereby each plate is stamped in exactly the same way. In this case, the rods will thus be perpendicular to all the plates in the pack, which facilitates assembly and results in an advantageous pressure distribution.

A second type of lifting device, the function of which substantially corresponds to the wire rings 29,30,31,32 is shown in FIG. 4. The lifting eye 32" comprises a flat iron bar with an elongated opening 35. The elongated opening 35 has a width corresponding to that of the bar 24. The lifting eye 32" is shown in lifting position with the bottom 37 of the opening 35 in contact with the under side of bar 24. The top end (not shown) of lifting eye 32" projects above the upper surface of the plate package allowing the package to be lifted. When not in use each lifting eye 32" is pushed back into the package, whereby the upper surface 36 of the opening contacts the upper surface of bar 24. In this position the top end of the lifting eye or lifting bar 32" is flush with or below the upper surface or plane of the plate packet.

With very large packs it can be expedient to stiffen the end walls of the pack against which the stop means or washers of the rods engage. One type of such a stiffened end wall is shown in FIG. 5. It is apparent from the Figure that two of the end plates 13,14, i.e. the plates which will engage against a tangential wall in the compartment, are joined to each other by rivets, of which the rivet 33 is shown. Each such end wall can consist of several plates, e.g. four plates joined to each other by riveting or spotwelding.

A pack of the kind described above is simple to manufacture, considerably cheaper than packs used previously and above all allows a very essential reduction of the gap between the walls of the compartment and the surfaces of the pack to be made, since only the stop means of the tension rods will lie outside the outer plates. These stop means can be made very thin, e.g. 3 mm, and only cause air gaps at the tangential walls. Since the plates are profiled, i.e. provided with raised portions, the stop means can be placed between such raised portions and will thereby lie completely within the configuration of the plate, i.e. the only factor affecting the size of the air gap is manufacturing accuracy.

Different modifications are possible, e.g. of the tension rods and their stop means. Instead of welded-on washers, nuts threaded onto stubs at the ends of the tension rods can be used for example. It is further possible to vary the number of tension rods, and for example to arrange two rods in an upper plane parallel to the end surfaces 3,4, said rods corresponding to the shown rods 19,20 and replacing the shown rods 21,22, which are placed in a central, vertical plane through the pack. It is also possible to have one centrally situated tension rod, which is provided with lifting eyes.

We claim:

1. A pack containing a stack of abutting, rectangular plates (11,12; 13,14) intended for placing in a compartment defined by radial (9,10) and tangential (7,8) walls in a regenerative heat exchanger, said plates being so profiled that they form passages between two parallel end surfaces (3,4) for a heat-exchanging medium, there being means including tension rods for keeping the plates together in the pack and means for lifting the pack, characterized in that said means for keeping the plates together consist of a plurality of mutually parallel tension rods (19,20,21,22) taken through mutually registering holes (15,16,17,18) in the respective plates, said holes having substantially the same size and shape as the cross-sectional area of the associated tension rod, that each rod at its extremeties has rigid securing means (23,27) coacting with the outer plates of the stack, arranged to hold the plates pressed against each other, and that a plurality of lifting eyes are arranged on one or more of the tension rods.

2. A pack as claimed in claim 1, characterized in that each tension rod has a rectangular cross section and that the narrow surfaces on each rod are parallel to the respective end surface (3,4) of the pack.

3. A pack as claimed in claim 1, characterized in that the height of the tension rod is substantially greater than its width.

4. A pack as claimed in any one of claims 1, 2 or 3, characterized in that the securing means consist of a head rigidly attached to each tension rod (24) and a separate securing plate (27) arranged for fixing to the free end of the rod projecting from the stack of plates.

5. A pack as claimed in claim 4, characterized in that the securing plate (27) is welded onto the rod.

6. A pack as claimed in claim 5, characterized in that at least both outermost plates (13,14) on each of the opposing end faces of the stack are rigidly joined to eachother.

7. A pack as claimed in claim 1, characterized in that the lifting eyes (29,30,31,32) consist of flexible steel rope rings.

8. A pack according to claim 1, characterized therein that each lifting eye consists of a bar (32'') provided with an elongated opening (35) through which a rod (24) is passed, said elongated opening permitting the bar (32'') to be set in a lifting position with its end projecting from the stack of plates and in an inactive position with said end inside the stack of plates.

* * * * *